US006481167B2

(12) United States Patent
Liddell

(10) Patent No.: US 6,481,167 B2
(45) Date of Patent: Nov. 19, 2002

(54) WINDOW COVER CONSTRUCTION

(76) Inventor: John C. Liddell, P.O. Box 71, Thackerville, OK (US) 73459

( * ) Notice: Subject to any disclaimer, the term of this patent is extended or adjusted under 35 U.S.C. 154(b) by 57 days.

(21) Appl. No.: 09/829,849

(22) Filed: Apr. 10, 2001

(65) Prior Publication Data

US 2002/0144463 A1 Oct. 10, 2002

(51) Int. Cl.[7] ..... E06B 3/26

(52) U.S. Cl. ..... 52/202; 52/198; 52/473; 52/302.1

(58) Field of Search ..... 52/202, 203, 198, 52/473, 302.1; 47/17; 160/89

(56) References Cited

U.S. PATENT DOCUMENTS 1,954,674 A * 4/1934 Lager ..... 47/17
2,808,626 A 10/1957 Sassano
2,931,578 A * 4/1960 Thompson ..... 126/629
5,566,738 A 10/1996 Yadidya
5,620,037 A * 4/1997 Apostolo ..... 160/118
5,887,386 A 3/1999 Alexanian et al.
5,893,242 A 4/1999 Perron
6,213,187 B1 * 4/2001 Hughes ..... 160/90

* cited by examiner

*Primary Examiner*—Robert Canfield
*Assistant Examiner*—Naoko Slack
(74) *Attorney, Agent, or Firm*—Henderson & Sturm LLP

(57) ABSTRACT

A cover construction (10) for windows, including a generally rectangular housing member (20) which is affixed to, and projects outwardly from, a window frame (101) via a mounting flange (26) and further includes an angled roof panel (21), a floor panel (25), a pair of opposed side panels (22), (23) and a generally open front panel (24).

The cover construction (10) also includes a pair of lower assemblies (30), (30') operatively associated with the front panel (24) as well as a vertical screen member (40) rearwardly offset from the lower assemblies (30), (30') and a horizontal screen member (41) associated with the floor panel (25) for allowing fresh air to enter through the window (100) even when the lower assemblies (30), (30') are in their closed position.

14 Claims, 3 Drawing Sheets

WINDOW COVER CONSTRUCTION

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of window coverings in general and in particular to an externally mounted shutter equipped housing which projects outwardly from the exterior of a structure.

2. Description of Related Art

As can be seen by reference to the following U.S. Pat. Nos. 2,808,626; 5,566,738; 5,887,386; and 5,893,242, the prior art is replete with myriad and diverse window coverings in the form of movable shutters or the like.

While all of the aforementioned prior art constructions are more than adequate for the basic purpose and function for which they have been specifically designed, they are uniformly deficient with respect to their failure to provide a simple, efficient, and practical window cover construction that enhances the external appearance of a structure to which it is attached while also providing an additional safeguard against unauthorized entry through the covered window as well as adding a degree of thermal insulation to the covered window.

While the prior art constructions offer one or more of the aforementioned beneficial functions, none of these patented constructions combine all of these benefits into a unified structure.

As a consequence of the foregoing situation, there has existed a longstanding need among homeowners for a new and improved window cover construction that incorporates all of the aforementioned beneficial aspects into a single unified design and the provision of such a window cover construction is the stated objective of the present invention.

BRIEF SUMMARY OF THE INVENTION

Briefly stated, the window cover construction that forms the basis of the present invention comprises in general a housing unit, a lower unit, and a screen unit.

As will be explained in greater detail further on in the specification, the housing unit includes a housing member that is designed to project outwardly from a window frame to accommodate both the lower unit and the screen unit. The housing unit further includes an angled roof panel, a pair of opposed side panels, a mounting panel, a generally open front panel, and a mounting flange that is used to secure the housing member to a window frame.

In addition, the lower unit includes a pair of independently operated lower assemblies employed to control the passage of light and air through the front panel wherein the lower assemblies are suspended from and are supported by the roof panel and the floor panel respectively.

Furthermore, the screen unit includes a vertical screen member disposed in a rearwardly offset and removable fashion relative to the lower assemblies, and a horizontal screen member associated with the floor panel to allow fresh air to pass through an open window even when the lower assemblies are disposed in their closed position.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
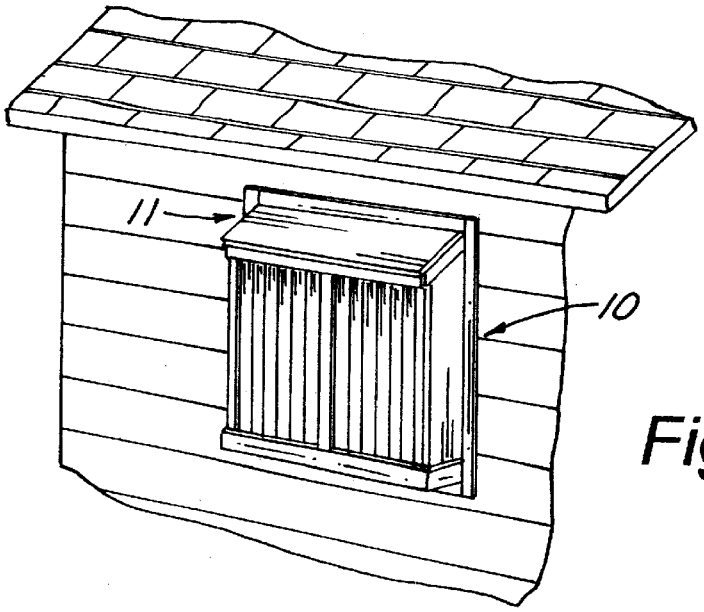
FIG. 1 is a perspective view of the window cover construction of this invention mounted on the exterior of a structure.
Figure 2:
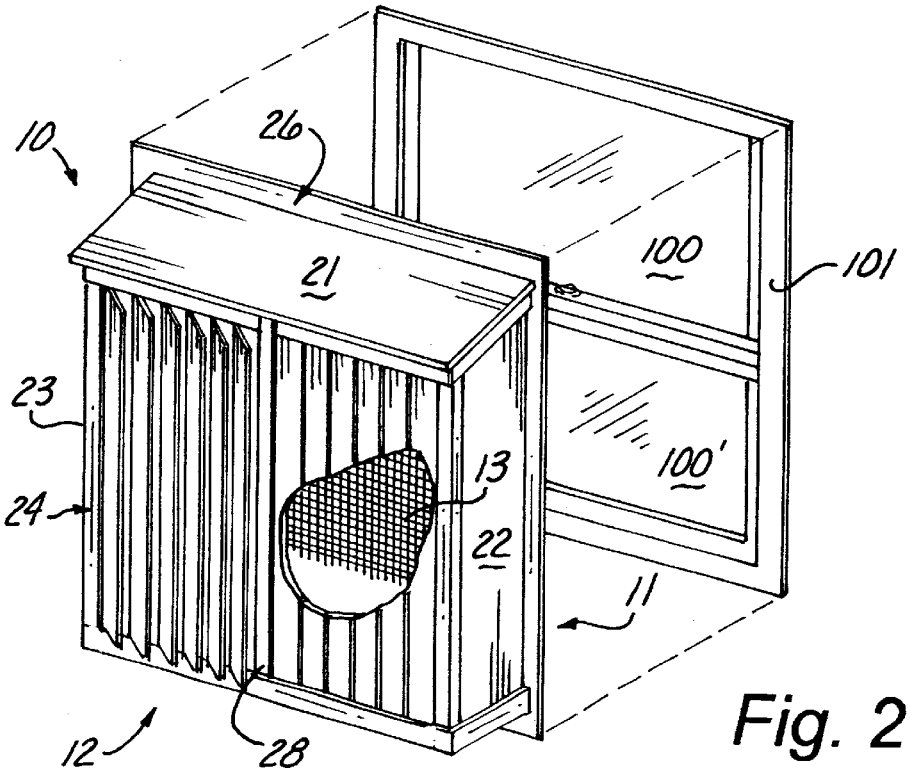
FIG. 2 is an exploded perspective view of the window cover construction and a conventional window.
Figure 3:
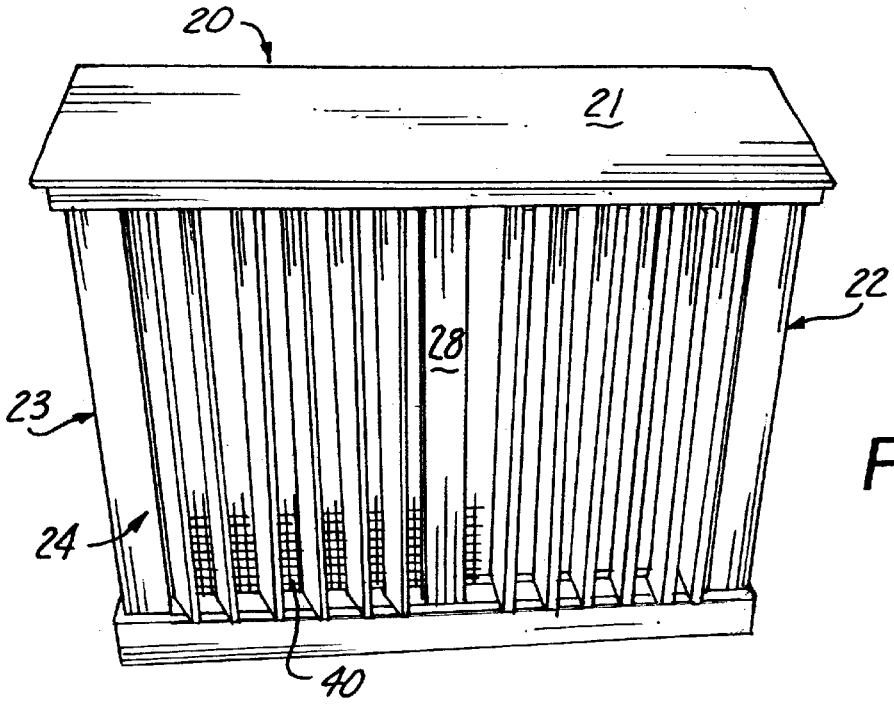
FIG. 3 is a front perspective view of the window cover construction minus the mounting flange.

As can be seen by reference to the drawings, and in particular to FIGS. 1 and 2, the window cover construction that forms the basis of the present invention is designated generally by the reference number 10. The construction 10 comprises in general a housing unit 11, a lower unit 12 and a screen unit 13. These units will now be described in seriatim fashion.

As shown in FIGS. 1 through 4, the housing unit 11 comprises a generally rectangular outer housing member 20 including an angled roof panel 21, a pair of opposed side panels 22 23, an open rectangular front panel 24, an open rectangular bottom panel 25 and an open rectangular mounting flange 26 which surrounds an enlarged rear opening 27 wherein the mounting flange 26 is dimensioned to fit over a conventional window frame 101 and be secured thereto by conventional fasteners (not shown) such as nails, adhesives, etc.

Figure 4:
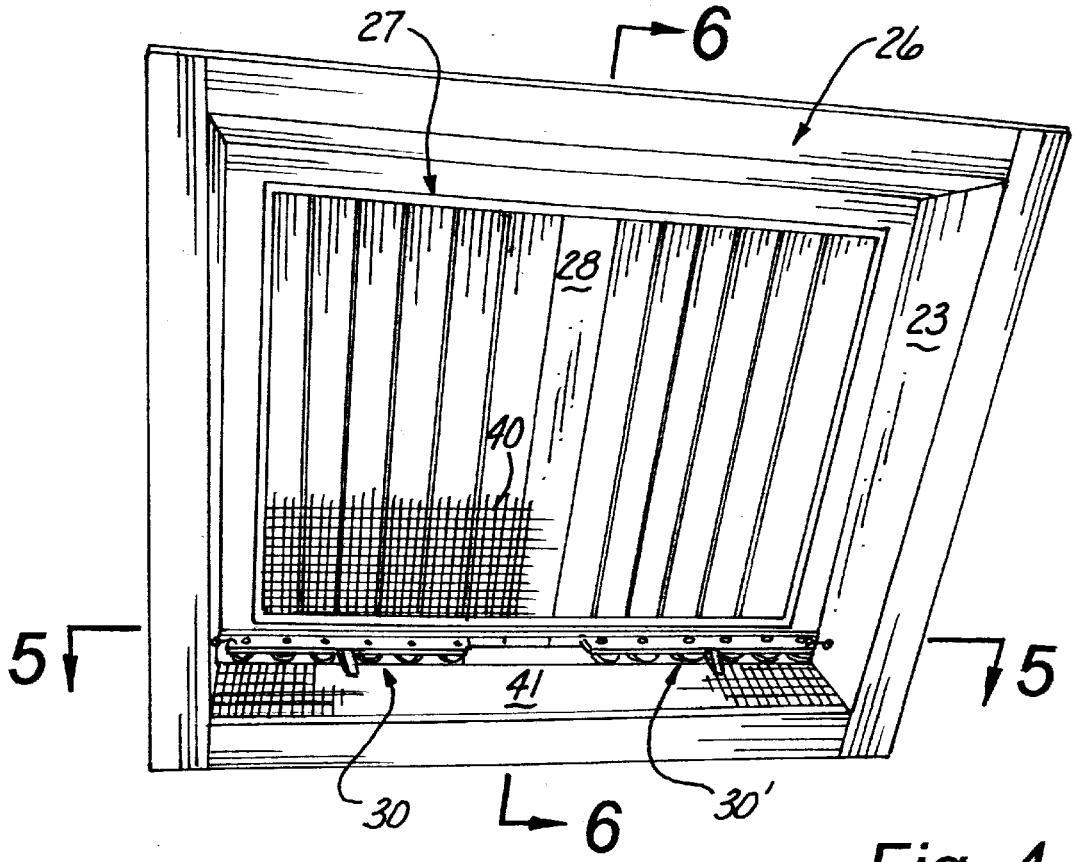
FIG. 4 is a rear perspective view of the window cover construction.
Figure 5:
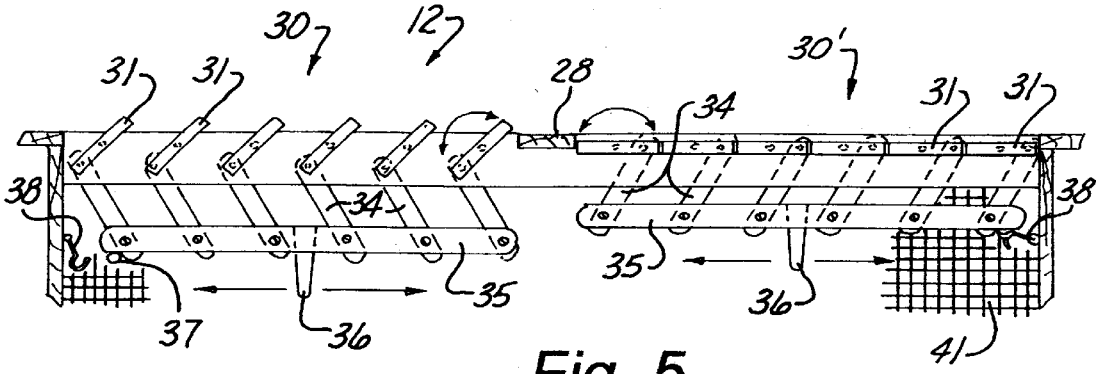
FIG. 5 is a cross-sectional view taken through line 5—5 of FIG. 4.
Figure 6:
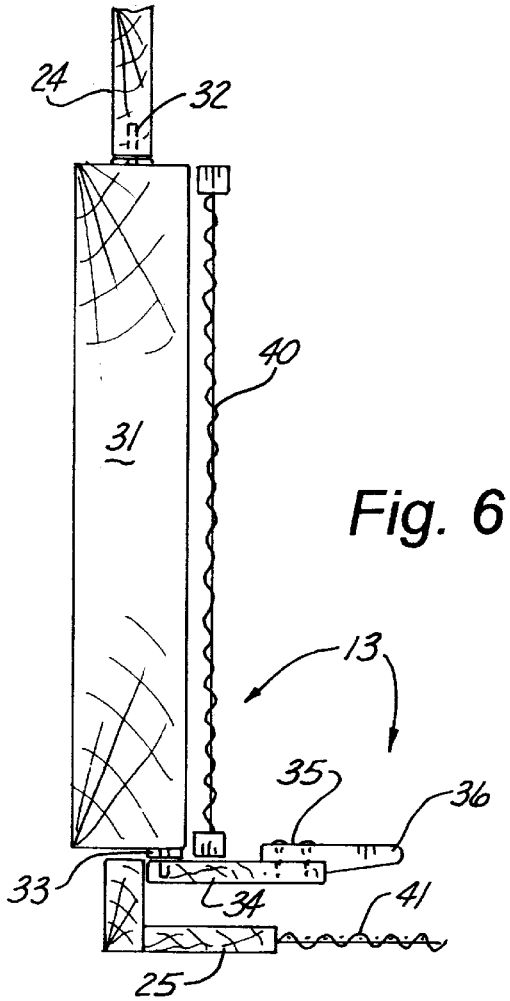
FIG. 6 is a cross-sectional view taken through line 6—6 of FIG. 4.

As can best be appreciated by reference to FIGS. 4 through 6, the lower unit 12 comprises a pair of independently operated lower assemblies 30, 30' suspended between the upper and lower portions of the open rectangular front panel 24 and including a plurality of lower slats 31 having their upper ends rotatably suspended from the upper portion of the front panel 24 as at 32 and their lower ends rotatably supported in an offset fashion as at 33 from a plurality of lever arms 34 pivotally connected to an actuator bar 35 provided with an actuator handle 36.

In addition, as can best be seen by reference to FIG. 5, each of the actuator bars 35 is provided with an eyelet 37 that is engageable with a hook 38 secured to one of the opposed side panels 22 so that each of the lower assemblies 30, 30' can be locked in the closed position as illustrated in FIG. 5.

As shown in FIGS. 3 through 6, the screen unit 13 comprises in general a removable vertical screen member 40 suspended in an offset fashion behind the lower assemblies 30, 30' and a fixed horizontal screen member 41 which forms the rear portion of the open rectangular bottom panel 25. In this manner even when the lower assemblies 30, 30' are closed to block out direct sunlight, wind or rain, the bottom screen member 41 will be available to allow fresh air to enter through one of the window panes 100, 100' in the window frame 101.

This last point is particularly important in those geographical areas that are prone to tornadoes since the recommended course of action is to open the windows in the home to equalize the pressure within the house and the ambient pressure. Unfortunately, up until the time the present invention was developed, this precautionary procedure left the window panes exposed to damage as well as eliminated an admittedly flimsy barrier to the entry of airborne debris from entering the home. However, with the advent of the present invention, those potentially disastrous consequences have been virtually eliminated.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. A window cover construction for protecting window panes within a window frame as well as allowing air to freely enter through an open window pane wherein the construction comprises:

a housing unit including a generally rectangular housing member having a roof panel, a pair of side panels, a floor panel and a generally open rectangular front panel;

means for mounting the housing member to a window frame; and a lower unit including a horizontal screen member associated with said floor panel.

2. The construction as in claim 1, wherein said at least one lower unit includes a plurality of lower slats pivotally suspended within said housing member.

3. The construction as in claim 2, wherein each of said plurality of lower slats has an,upper end pivotally suspended from said roof panel.

4. The construction as in claim 3, wherein each of said plurality of lower slats has a lower end pivotally supported in an offset fashion on a lever arm.

5. The construction as in claim 4, wherein each of the lever arms is connected to an actuator bar.

6. The construction as in claim 5, wherein the actuator bar is provided with an actuator handle.

7. The construction as in claim 2, further comprising locking means associated with said at least one lower unit for maintaining the plurality of lower slats in the closed position relative to said open rectangular front panel.

8. The construction as in claim 2, wherein said roof panel is angled.

9. The construction as in claim 2, wherein the lower unit comprises a pair of lower assemblies operatively associated with said generally open rectangular front panel.

10. The construction as in claim 9, wherein said front panel is further provided with a stiffening slat disposed intermediate the pair of lower assemblies.

11. The construction as in claim 2, wherein the screen member further includes a vertical screen member disposed in a rearwardly offset fashion relative to said at least one lower unit.

12. The construction as in claim 11, wherein said vertical screen member is removably disposed within the interior of the housing member.

13. The construction as in claim 2, wherein said means for mounting the housing member on the window frame comprises a mounting flange projecting outwardly from selected ones of the roof, floor and opposed side panels.

14. The construction as in claim 2, wherein said means for mounting the housing member on the window frame comprises a generally open rectangular mounting flange that projects outwardly from said roof, floor and opposed side panels.

* * * * *